United States Patent [19]

Weinzettel et al.

[11] 4,448,304

[45] May 15, 1984

[54] REMOUNT KIT FOR REPRESENTATIONS OF STONE-BEARING RINGS

[75] Inventors: Michael Weinzettel, St. Louis, Mo.; Walter Weeks, Collinsville, Ill.

[73] Assignee: Eisenstadt Company, St. Louis, Mo.

[21] Appl. No.: 362,600

[22] Filed: Mar. 29, 1982

[51] Int. Cl.[3] ..... B65D 71/00

[52] U.S. Cl. ..... 206/223; 63/30; 206/566; 269/3; 269/47; 434/81

[58] Field of Search ..... 63/1 R, 2, 15, 29 R, 63/31; 434/81, 386; 269/3, 47; 206/223, 229, 230, 566, 575, 577

[56] References Cited

U.S. PATENT DOCUMENTS

| | | | |
|---|---|---|---|
| 242,422 | 6/1881 | Ballou | 63/29 R |
| 1,709,937 | 4/1929 | Everard | 434/566 |
| 2,144,968 | 1/1939 | Gerth | 206/223 |
| 2,184,749 | 12/1939 | Manne et al. | 63/15 |
| 2,253,343 | 8/1941 | Nalick | 63/29 R |
| 2,874,707 | 2/1959 | Koppel | 206/229 |
| 3,035,689 | 5/1962 | Arnheiter | 206/223 |
| 3,071,940 | 1/1963 | Schneider | 63/15 |
| 3,255,611 | 6/1966 | Doherty | 434/81 |
| 3,483,716 | 12/1969 | Stenzler | 63/15 |
| 3,619,913 | 11/1971 | Albrecht | 434/386 |
| 4,099,611 | 7/1978 | Feibelman | 206/566 X |
| 4,295,640 | 10/1981 | Merrell | 269/47 |

FOREIGN PATENT DOCUMENTS

| | | | |
|---|---|---|---|
| 347398 | 4/1931 | United Kingdom | 63/29 R |

*Primary Examiner*—F. Barry Shay

*Attorney, Agent, or Firm*—Rogers, Eilers & Howell

[57] ABSTRACT

A remount kit for stone-bearing rings includes a support that releasably holds a plurality of specifically-different rings, each of which is formed and dimensioned to represent a ring to which at least one stone can be secured, and a plurality of stud-mounted stones, each of which is formed and dimensioned to represent a stone that could be secured to at least one of the rings represented by the plurality of rings. The studs of the stud-mounted stones are dimensioned to project inwardly of the finger-engaging surface of a selected ring, of the selected plurality of rings, whenever one or more of the stud-mounted stones is disposed in juxtaposition to that selected ring to illustrate the position or positions which the stone or stones, represented by the stud-mounted stones or stones, would occupy when secured to the ring represented by the selected ring.

15 Claims, 7 Drawing Figures

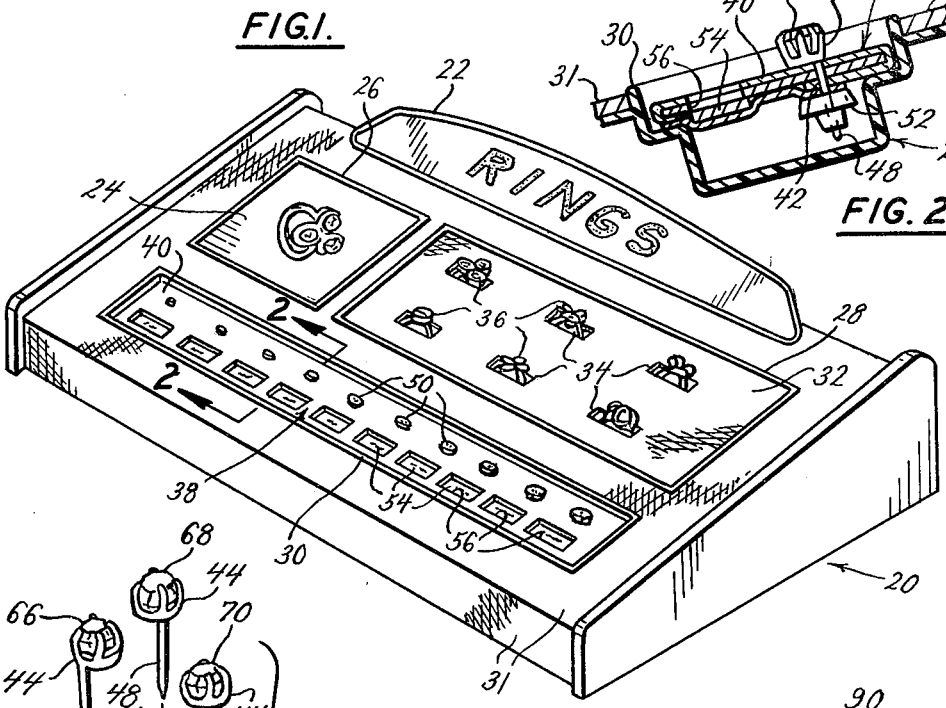
FIG. 1.
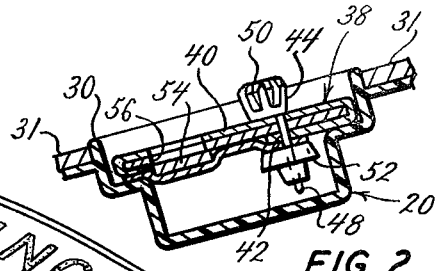
FIG. 2.
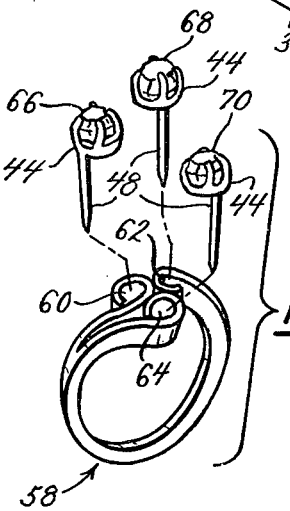
FIG. 3.
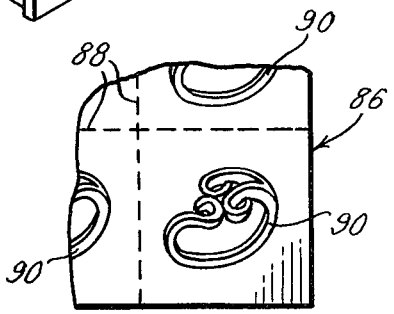
FIG. 7.
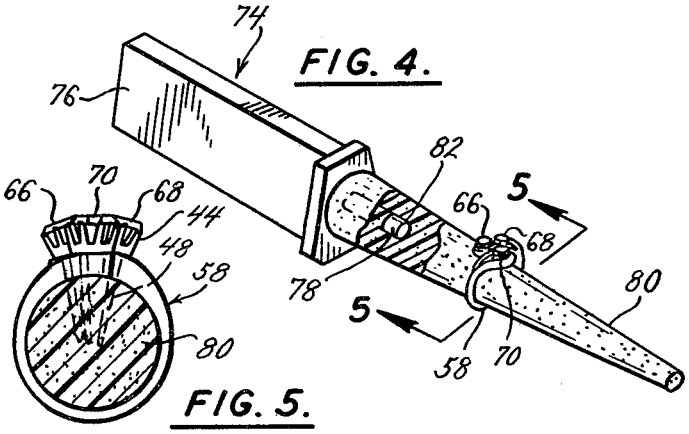
FIG. 4.
FIG. 5.
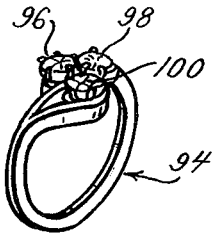
FIG. 6.

REMOUNT KIT FOR REPRESENTATIONS OF STONE-BEARING RINGS

BACKGROUND OF THE INVENTION

Owners of stone-bearing rings sometimes want to have the stones of those rings removed and mounted on different rings. In some instances, the metal of the original rings becomes so thin from long usage that different rings must be used. In other instances, the styling of the original rings becomes outdated. Similarly, owners of pendants, bracelets and other stone-bearing jewelry sometimes want to have the stones of that jewelry mounted on rings.

SUMMARY OF THE INVENTION

The remount kit provided by the present invention has a support which releasably holds a number of individually-different rings; and each of those rings if formed and dimensioned to represent a ring to which at least one stone can be secured. The rings of the remount kit can be made of non-precious metal or of precious metal, but preferably will be made of the same metal of which the rings they represent will be made. The support also releasably holds a number of stud-mounted stones which are different in size; and each of those stones is formed and dimensioned to represent a stone which could be secured to at least one of the rings represented by the plurality of rings. The studs of the stud-mounted stones are dimensioned to project inwardly of the finger-engaging surface of a selected ring of the number of individually-different rings whenever one or more of the stud-mounted stones is disposed in juxtaposition to the selected ring to illustrate the position or positions which the stone or stones, represented by the stud-mounted stone or stones, would occupy when secured to the ring corresponding to the selected ring. It is, therefore, an object of the present invention to provide a remount kit that has a support which releasably holds a number of individually-different rings and that also releasably holds a number of stud-mounted stones.

The remount kit provided by the present invention also has a ring wand to which a selected one of the individually-different rings and one or more stud-mounted stones can be secured to provide an essentially-complete showing of the appearance of a ring represented by the selected ring and of stones represented by the stud-mounted stones. It is, therefore, an object of the present invention to provide a remount kit that has a ring wand to which a selected one of individually-different rings and one or more stud-mounted stones can be secured.

BRIEF DESCRIPTION OF THE DRAWING

In the drawing, FIG. 1 is a perspective view of one preferred embodiment of support, rings and stud-mounted stones for the remount kit provided by the present invention, FIG. 2 is a sectional view, on a larger scale, which is taken along the plane indicated by the line 2—2 in FIG. 1, FIG. 3 is a perspective view, on the scale of FIG. 2, of one of the rings and three of the stud-mounted stones of FIG. 1, FIG. 4 is a partially-sectioned perspective view of a ring wand of the remount kit of the present invention, and it shows the ring and stud-mounted stones of FIG. 3 secured to ring wand, FIG. 5 is a sectional view, on a larger scale, which is taken along the plane indicated by the line 5—5 in FIG. 4, FIG. 6 is a perspective view, on a scale which is slightly smaller than that of FIG. 3, of a finished ring, and FIG. 7 is a plan view of a portion of a perforated sheet which bears representations of the ring of FIG. 3.

DETAILED DESCRIPTION OF THE PREFERRED EMBODIMENT

Referring particularly to the drawing, the numeral 20 generally denotes a support which is part of one preferred embodiment of remount kit that is provided by the present invention. That support has an upper surface which inclines upwardly and rearwardly; and a panel 22 inclines upwardly and rearwardly from the upper end of that upper surface. That panel can bear different indicia, such as a trademark, a slogan, descriptive words or phrases, advertising text or the like. In the embodiment shown in FIG. 1, the generic word "RINGS" is displayed on the panel 22.

The upper surface of the support 20 has three rectangular areas which are defined by shallow, upstanding borders 26, 28 and 30. In the preferred embodiment of the present invention, those borders are gold colored and serve as ornamental frames for the objects bounded by them. The numeral 31 denotes a cloth or simulated coth which covers the front of the support 20, and which also covers those portions of the upper surface of that support which are external of the borders 26, 28 and 30. That cloth or simulated cloth will have a desirably pleasing color and "feel".

The numeral 24 denotes a colorful representation of a stone-bearing ring of ornamental and pleasing design. That representation is within the space bounded by the border 26.

The numeral 32 denotes a cloth or simulated cloth which fills the area that is defined by the border 28. That cloth has six recesses 34 therein which are in register with six recesses in the upper surface of the support 20. Those recesses are dimensioned to closely accommodate the ring-engaging portions of six specifically-different rings 36. Each of those rings is designed and dimensioned to accommodate one or more stones; and each of those rings is made from a mold from which corresponding identical rings are made.

The numeral 38 denotes an elongated member which fills the space that is defined by the border 30. Cloth or simulated cloth 40 covers the upper and lower surfaces of the member 38. A number of openings 42 are spaced along the length of the elongated support 38; and those openings are aligned to releasably support the studs 48 of a number of aligned stud mountings 44 for stones. Each of those stud mountings has a plurality of stone-holding prongs 46 and a stone 50. The stones 50 of the various stud mountings 44 will differ in size and, preferably, will be arranged in order, from left to right, of increasing size. Retainers 52 are telescoped onto the lower ends of the studs 48 to prevent accidental separation of any of the stud mountings 44 from the elongated member 38.

A number of generally-rectangular openings 56 are provided in the cloth 40 and in the support 38. Indicia-bearing inserts 54 underlie the openings 56; and the indicia thereon will provide information regarding the adjacent stones 50 of the stud mountings 44. In the preferred embodiment of the present invention, that information is the weight of each stone in carats. The inserts 54 could be a series of spaced-apart members which were arranged in a row to underlie the various openings 56. However, in the preferred embodiment of the present invention, those inserts constitute portions of a single elongated insert on which the indicia are suitably formed to be in register with the openings 56.

The numeral 58 in FIGS. 3–5 generally denotes a ring which is one of the rings 36 of FIG. 1. That ring has openings 60, 62 and 64 therein which can receive the studs 48 of stud-mounted stones 66, 68 and 70. As indicated by the dashed lines, the stud 48 of the stud-mounted stone 66 can be disposed within the opening 60, the stud 48 of the stud-mounted stone 68 can be disposed within the opening 62, and the stud 48 of the stud-mounted stone 70 can be disposed within the opening 64.

It will be noted that the stud 48 of each of the stones 50 is mounted eccentrically of the geometric center of that stone. Such an arrangement is desirable, because it permits the rotation of those studs relative to the openings 60, 62 and 64 to automatically shift the geometric centers of those stones laterally relative to those openings. In addition, each of the openings 60, 62 and 64 has an inner diameter which is larger than the diameter of each stud 48. The resulting "play" between the surfaces of those studs and the inner surfaces of those openings will coact with the eccentric mountings of those studs relative to the stones 66, 68 and 70 to provide an almost limitless combination of positions and spacings of the geometric centers of those stones relative to the ring 58. The studs 48 are dimensioned so they project substantial distances inwardly of the finger-engaging surfaces of the ring 58, as indicated by FIG. 5.

The numeral 74 generally denotes a ring wand which has a handle 76 with a generally-cylindrical projection 78 thereon. The generally-conical ring-receiving portion 80 of that ring wand is made of a form-retaining but readily-penetrated material such as foam plastic. That ring-receiving portion has a cloth or simulated cloth cover, and it also has a socket 82 in the large-diameter end thereof. That socket snugly accommodates the generally-cylindrical projection 78 on the handle 76 of the ring wand.

The numeral 86 in FIG. 7 generally denotes a perforated sheet that has lines 88 of perforations which subdivide that sheet into a number of rectangles. Each of those rectangles bears a representation 90 of the ring 58. A different perforated sheet 86 will be provided for each of the six rings 36; and each of the rectangles, defined by the perforated lines 88 on any given sheet 86, will display a picture 90 of the same ring. In the one preferred embodiment of the present invention, each sheet 86 has fifteen rectangles, and each of those rectangles bears a representation of a ring. The perforated lines 88 make it easy to separate any one of the rectangles from the rest of the sheet 86.

The numeral 94 generally denotes a completed ring which is essentially identical to the ring 58, and which has stones 96, 98 and 100 that are essentially identical to the stones 66, 68 and 70. The stones of that ring usually will be one or more stones from a customer's original ring, pendant, bracelet or other item of jewelry. However, if a customer has only one stone from a ring, pendant, bracelet or other item of jewelry and would like to have additional stones on a new ring, the jeweler can supply additional stones. In fact, if the customer does not have any stones from a ring, pendant, bracelet or other item of jewelry, all of the stones 96, 98 and 100 can be supplied by the jeweler.

In using the remount kit provided by the present invention, the jeweler will exhibit the support 20 and the rings 36 thereon to the customer. In the preferred embodiment of the present invention, only six rings are held and displayed. However, in other embodiments of the present invention, the support 20 is made large enough so many more rings can be held and displayed. As a result, by using a support 20 wherein more than six rings are displayed, or by using two or more supports 20 in which each of six rings are displayed, a jeweler can display a large number of individually-different rings to the customer. Each ring is readily removed from the recess therefor and displayed on the ring wand 74, or can be slipped onto one of the customer's fingers as desired. Once a suitable ring 36 has been selected by the customer, the jeweler will carefully examine the stone or stones on the customer's original ring, pendant, bracelet or other item of jewelry to determine the nature, size, color and quality of each stone. Thereafter, the jeweler will lift the elongated member 38, remove the retainer 52 on the stud 48 of a stud-mounted stone 50 of the kind and size of each stone of the customer. Subsequently, the ring 58 will be telescoped over the ring-receiving portion 80 of the ring wand 74, and then the stud 48 of one of the stud-mounted stones 66, 68 and 70 will be pressed through the cloth and into the form-retaining but readily-penetrated material of that ring-holding portion. As indicated by FIG. 3, that stud will usually pass through an opening which is provided in the ring 58. However, that stud can be passed through portions of the cloth and of the form-retaining, easily-penetrated, ring-receiving portion 80 of the wand 74 which are immediately adjacent an outer edge of that ring. As is well known in the art of stone-bearing rings, the prong-equipped mountings for stones can be secured to the edges, as well as to inwardly-disposed portions, of rings.

After a stud 48 has been pressed through the cloth on, and into the form-retaining, easily-penetrated, ring-receiving portion 80 of the ring wand 74, the stone supported by that stud can be rotated to move it closer toward, or further away from, an adjacent portion of the ring 58. Also, that ring can be shifted slightly relative to the stud 48 even when that stud is disposed within an opening in that ring; because the diameters of those openings are larger than the diameter of that stud. Where the stud 48 is disposed adjacent an edge of, rather than within an opening in, the ring 58, that ring can be shifted much larger distances relative to that stud and the stone supported thereby. Additional stud-mounted stones can be associated with the ring by pressing the studs 48 thereof through the cloth and into the form-retaining, easily-penetrated, ring-receiving portion 80 of the ring wand 74. Those stones also can be rotated relative to the ring.

When a desirable arrangement of stones and their placement relative to the ring 58 has been approved by the customer, the jeweler will detach one of the rectangles from the perforated sheet 86. He will then suitably mark the locations, natures, sizes, colors and qualities of the stones submitted or desired by the customer. Thereafter, an assembler will use that detached rectangle and the information thereon to select a ring 94 which is identical to the ring 58, and hence is identical to the ring which was selected by the customer. The assembler then will secure the stones 96, 98 and 100 in the positions desired by the customer and indicated by the indicia on the rectangle which was detached from the perforated sheet 86. When completed, the ring 94 will include stones 96, 98 and 100 which were supplied or selected by the customer, and which are secured to the ring in the exact placement and arrangement that were demonstrated to the customer by use of the ring 58, the stud-mounted stones 66, 68 and 70, and the ring wand 74.

The ring-receiving portion of the ring wand 74 is made detachable from the handle 76, because repeated insertions of the studs 48 of the various stud-mounted stones into that ring-receiving portion will eventually degrade the appearance of that ring-receiving portion. However, it is a simple matter to replace a degraded ring-receiving portion 80 with a fresh ring-receiving portion; because all that need be done is apply a strong pull to the degraded ring-receiving portion to separate it from the projection 78 on the handle 76, and then telescope the recess in a fresh ring-receiving portion over that projection.

The jeweler may sometimes wish to provide an initial interrelating of a ring and of a stud-mounted stone even before that ring is telescoped over the ring-receiving portion of the ring wand. To do so, the jeweler will usually press the thumb and forefinger of one hand together within the finger-receiving portion of a ring 58, and then pass the stud of a stud-mounted stone into the finger-receiving area of the ring so it can be held by that thumb and forefinger. As indicated hereinbefore, that stud could pass through an opening in that ring or could pass adjacent one edge of that ring. Further studs of stud-mounted stones also could be held by the confronting portions of the jeweler's thumb and forefinger, as long as the number of studs was relatively small. It will usually be desirable to have the ring and the stud-mounted stones held by the ring wand 74, so the customer can use that ring wand to dispose that ring and those stud-mounted stones in different attitudes and in different positions relative to the available light. However, if a customer were to decide on the position and arrangement of a stud-mounted stone before the ring and that stud-mounted stone were telescoped over the ring-receiving portion of the ring wand, there would be no need to assemble that ring and that stud-mounted stone with that ring wand.

After the desired arrangement of the stud-mounted stone and ring have been settled upon, the ring 58 will be returned to its recess within the support 20 and the stud-mounted stone 50 will have the stud 48 thereof telescoped through the opening 42 in the elongated member 38. Thereafter the retainer 52 will be telescoped over the lower end of that stud to prevent accidental separation of that stud-mounted stone from that member, and then that member will be set within the space defined by the border 30.

Because the ring 94 will be supplied by the jeweler, each of the rings 36 will be made to have exactly the same size, shape, finish and luster as the ring which will ultimately be supplied to the customer. Thus, if the ring desired by the customer is to be a gold ring, the rings 36 preferably will be gold rings with the same gold content, color and finish as the desired ring. However, because the stones will usually, at least in part, be furnished by the customer, the stones 50 need not be precious stones and, instead, could be made of less precious material. In the particular remount kit shown in FIG. 1, all of the stones are clear and are intended to simulate diamonds. However, where desired, other remount kits may have diamonds, rubies and other precious stones. In remount kits which have large numbers of stud-mounted gems, various combinations of kinds and sizes of different stones can be provided. If desired, further remount kits could be provided with appropriately-recessed supports which would hold pendants, bracelets or other jewelry that was designed to be filled with stones; and, in displaying assemblies of stud-mounted stones with those pendants, bracelets or other jewelry, the jeweler would hold the studs of those stud-mounted stones and the pendants, bracelets or other jewelry in his fingers.

Whereas the drawing and accompanying description have shown and described a preferred embodiment of the present invention, it should be apparent to those skilled in the art that various changes may be made in the form of the invention without affecting the scope thereof.

What we claim is:

1. A remount kit for stone-bearing rings which comprises a plurality of individually-different, displayable, demonstration rings, each of which is formed and dimensioned to represent an ultimate ring to which at least one ultimate stone can be secured, and a plurality of individually-different, stud-mounted, displayable, demonstration stones, each of which is formed and dimensioned to represent an ultimate stone which could be secured to at least one of the ultimate rings represented by said plurality of individually-different, displayable, demonstration rings, the studs of said individually-different, stud-mounted, displayable, demonstration stones being dimensioned to project substantial distances inwardly of the finger-engaging surface of a selected, displayable, demonstration ring of said plurality of individually-different, displayable demonstration rings, said studs thereby providing means by which they may be easily held for temporary displaying of one or more selected, stud-mounted, displayable, demonstration stone or stones immediately adjacent said selected, displayable, demonstration ring, whenever said one or more selected, stud-mounted, displayable, demonstration stone or stones is or are disposed in juxtaposition to said selected, displayable, demonstration ring to enable a viewer to visualize the position or positions which the ultimate stone or stones, represented by said one or more selected, stud-mounted, displayable, demonstration stone or stones, would occupy when secured to the ultimate ring corresponding to said selected, displayable, demonstration ring and also to enable the viewer to visualize the appearance of said ultimate ring and ultimate stone or stones in any desired attitude or position of said ultimate ring by enabling said selected, displayable, demonstration ring to be moved to any corresponding attitude or position while having said one or more selected, stud-mounted, displayable, demonstration stone or stones temporarily associated with it.

2. A remount kit as claimed in claim 1 wherein the studs of said individually-different, stud-mounted, displayable, demonstration stones are eccentric of the geometric centers of said individually-different, stud-mounted, displayable, demonstration stones, whereby rotation and subsequent holding of said studs of said individually-different, stud-mounted, displayable, demonstration stones can dispose said individually-different, stud-mounted, displayable, demonstration stones in a multiplicity of desired positions that are displaced from each other and that are displaced circumferentially or axially relative to said selected, displayable, demonstration ring.

3. A remount kit as claimed in claim 1 wherein each of said plurality of individually-different, displayable, demonstration rings has at least one stud-receiving opening therein, and wherein each of said studs of said individually-different, stud-mounted, displayable, demonstration stones is appreciably smaller than said stud-receiving openings in said plurality of individually-different, displayable, demonstration rings, whereby a stud of any of said individually-different, stud-mounted, displayable, demonstration stones can be set in different angularly-displaced positions while it is disposed within one of said stud-receiving openings in said plurality of individually-different, displayable, demonstration rings.

4. A remount kit as claimed in claim 1 wherein a display-like support has a plurality of spaced recesses that releasably hold the shanks of said plurality of individually-different, displayable, demonstration rings, wherein said support has a plurality of small diameter openings that releasably hold said plurality of individually-different, stud-mounted, displayable, demonstration stones, wherein said support holds identifying indicia adjacent said plurality of individually-different, stud-mounted, displayable, demonstration stones, and wherein two-dimensional representations of selected rings of said plurality of individually-different, displayable, demonstration rings have a space therein which can have the locations and natures of stones recorded thereon to facilitate the subsequent proper positioning of one or more of said ultimate stones on said ultimate ring.

5. A remount kit as claimed in claim 1 wherein a display-like support has a plurality of spaced recesses that releasably hold the shanks of said plurality of individually-different, displayable, demonstration rings, wherein a supporting member normally rests upon said support and has a plurality of small-diameter openings that releasably hold the studs of said individually-different, stud-mounted, displayable, demonstration stones, whereby said plurality of individually-different, stud-mounted, displayable, demonstration stones are releasably secured to said supporting member, wherein said supporting member holds identifying indicia adjacent said plurality of individually-different, stud-mounted, displayable, demonstration stones, and wherein said supporting member is readily separable from said support to facilitate the separation of any one of said plurality of individually-different, stud-mounted, displayable, demonstration stones from said supporting member prior to the positioning of said one of said plurality of individually-different, stud-mounted, displayable, demonstration stones in juxtaposition to said selected displayable, demonstration ring.

6. A remount kit for stone-bearing rings which comprises a plurality of rings, each of which is formed and dimensioned to represent a ring to which at least one stone can be secured, and a plurality of stud-mounted stones, each of which is formed and dimensioned to represent a stone which could be secured to at least one of the rings represented by said plurality of rings, the studs of said stud-mounted stones being dimensioned to project substantial distances inwardly of the finger-engaging surface of a selected ring of said plurality of rings, said studs thereby providing means by which they may be easily held for temporary displaying whenever one or more of said stud-mounted stones is disposed in juxtaposition to said selected ring to illustrate the position or positions which the stone or stones, represented by said stud-mounted stone or stones, would occupy when secured to the ring corresponding to said selected ring, said remount kit further including a display-like support which has a plurality of spaced recesses that releasably hold the shanks of said plurality of individually-different, displayable, demonstration rings, said support having a plurality of small-diameter openings that releasably hold the studs of said plurality of individually-different, stud-mounted, displayable, demonstration stones, and said support holding identifying indicia adjacent said plurality of individually-different, stud-mounted, displayable, demonstration stones.

7. A remount kit for stone-bearing rings which comprises a plurality of rings, each of which is formed and dimensioned to represent a ring to which at least one stone can be secured, and a plurality of stud-mounted stones, each of which is formed and dimensioned to represent a stone which could be secured to at least one of the rings represented by said plurality of rings, the studs of said stud-mounted stones being dimensioned to project substantial distances inwardly of the finger-engaging surface of a selected ring of said plurality of rings whenever one or more of said stud-mounted stones is disposed in juxtaposition to said selected ring to illustrate the position or positions which the stone or stones, represented by said stud-mounted stone or stones, would occupy when secured to the ring corresponding to said selected ring, said remount kit further including a ring wand having a ring-receiving portion for mounting within the finger-receiving area of one of said plurality of rings, said ring wand being form-retaining but readily-penetrated to permit the insertion of the ends of said studs of said individually-different, stud-mounted, displayable, demonstration stones into said ring-receiving portion when said latter individually-different, stud-mounted, displayable, demonstration stones have been placed in said juxtaposition with said one of said plurality of rings.

8. A remount kit for stone-bearing rings which comprises a plurality of rings, each of which is formed and dimensioned to represent a ring to which at least one stone can be secured, and a plurality of stud-mounted stones, each of which is formed and dimensioned to represent a stone which could be secured to at least one of the rings represented by said plurality of rings, the studs of said stud-mounted stones being dimensioned to project inwardly of the finger-engaging surface of a selected ring of said plurality of rings whenever one or more of said stud-mounted stones is disposed in juxtaposition to said selected ring to illustrate the position or positions which the stone or stones, represented by said stud-mounted stone or stones, would occupy when secured to the ring corresponding to said selected ring, said remount kit further including a ring wand having a ring-receiving portion for mounting within the finger-receiving area of one of said plurality of rings, said ring wand being form-retaining but readily-penetrated to permit the insertion of the ends of said studs of said individually-different, stud-mounted, displayable, demonstration stones into said ring-receiving portion when said latter individually-different, stud-mounted, displayable, demonstration stones have been placed in said juxtaposition with said one of said plurality of rings, and wherein said ring-receiving portion is removable when it becomes degraded so it can be replaced by a fresh ring-receiving portion.

9. A remount kit for stone-bearing rings which comprises a plurality of rings, each of which is formed and dimensioned to represent a ring to which at least one stone can be secured, and a plurality of stud-mounted stones, each of which is formed and dimensioned to represent a stone which could be secured to at least one of the rings represented by said plurality of rings, the studs of said stud-mounted stones being dimensioned to project inwardly of the finger-engaging surface of a selected ring of said plurality of rings whenever one or more of said stud-mounted stones is disposed in juxtaposition to said selected ring to illustrate the position or positions which the stone or stones, represented by said stud-mounted stone or stones, would occupy when secured to the ring corresponding to said selected ring, said remount kit further including a ring wand having a ring-receiving portion for mounting within the finger-receiving area of one of said plurality of rings, said ring wand being form-retaining but readily-penetrated to permit the insertion of the ends of said studs of said individually-different, stud-mounted, displayable, demonstration stones into said ring-receiving portion when said latter individually-different, stud-mounted, displayable, demonstration stones have been placed in said juxtaposition with said one of said plurality of rings, and wherein said ring-receiving portion can simultaneously hold one or more of said individually-different, stud-mounted, displayable, demonstration stones adjacent said selected displayable, demonstration ring.

10. A remount kit for stone-bearing rings which comprises a plurality of rings, each of which is formed and dimensioned to represent a ring to which at least one stone can be secured, and a plurality of stud-mounted stones, each of which is formed and dimensioned to represent a stone which could be secured to at least one of the rings represented by said plurality of rings, the studs of said stud-mounted stones being dimensioned to project substantial distances inwardly of the finger-engaging surface of a selected ring of said plurality of rings said studs thereby providing means by which they may be easily held for temporary displaying whenever one or more of said stud-mounted stones is disposed in juxtaposition to said selected ring to illustrate the position or positions which the stone or stones, represented by said stud-mounted stone or stones, would occupy when secured to the ring corresponding to said selected ring, said studs of said stud-mounted stones being eccentric of the geometric centers of said stud-mounted stones, whereby rotation of one of said stud-mounted stones while the stud of said one stud-mounted stone is held adjacent said selected ring will cause said one stud-mounted stone to move both circumferentially and axially of said selected ring.

11. A remount kit for stone-bearing rings which comprises a plurality of rings, each of which is formed and dimensioned to represent a ring to which at least one stone can be secured, and a plurality of stud-mounted stones, each of which is formed and dimensioned to represent a stone which could be secured to at least one of the rings represented by said plurality of rings, the studs of said stud-mounted stones being dimensioned to project substantial distances inwardly of the finger-engaging surface of a selected ring of said plurality of rings whenever one or more of said stud-mounted stones is disposed in juxtaposition to said selected ring to illustrate the position or positions which the stone or stones, represented by said stud-mounted stone or stones, would occupy when secured to the ring corresponding to said selected ring, said studs of said stud-mounted stones being eccentric of the geometric centers of said stud-mounted stones, each of said plurality of rings having at least one stud-receiving opening therein, and each of said studs of said stud-mounted stones being selectively disposable within said stud-receiving openings in said plurality of rings, whereby rotation of one of said stud-mounted stones while the stud of said one stud-mounted stone is held in one of said stud-receiving openings in said plurality of rings will cause said one stud-mounted stone to move both circumferentially and axially of said selected ring.

12. A remount kit for stone-bearing rings which comprises a plurality of rings, each of which is formed and dimensioned to represent a ring to which at least one stone can be secured, and a plurality of stud-mounted stones, each of which is formed and dimensioned to represent a stone which could be secured to at least one of the rings represented by said plurality of rings, the studs of said stud-mounted stones being dimensioned to project inwardly of the finger-engaging surface of a selected ring of said plurality of rings whenever one or more of said stud-mounted stones is disposed in juxtaposition to said selected ring to illustrate the position or positions which the stone or stones, represented by said stud-mounted stone or stones, would occupy when secured to the ring corresponding to said selected ring, the studs of said stud-mounted stones are eccentric of the geometric centers of said stud-mounted stones, wherein each said plurality of rings has at least one stud-receiving opening therein, wherein each of said studs of said stud-mounted stones is selectively disposable within said stud-receiving openings in said plurality of rings, and wherein each of said studs of said stud-mounted stones is appreciably smaller than said stud-receiving openings, whereby lateral shifting of the stud of one of said stud-mounted stones can coact with rotation of said one of said stud-mounted stones, while said stud of said one stud-mounted stone is held within one of said stud-receiving openings in said selected ring, to cause substantial relative movement of said one stud-mounted stone both circumferentially and axially of said selected ring.

13. A remount kit for stone-bearing jewelry items which comprises a plurality of individually-different, displayable, demonstration jewelry items, each of which is formed and dimensioned to represent an ultimate jewelry item to which at least one ultimate stone can be secured, and a plurality of individually-different, stud-mounted, displayable, demonstration stones, each of which is formed and dimensioned to represent an ultimate stone which could be secured to at least one of the ultimate jewelry items represented by said plurality of individually-different, displayable, demonstration jewelry items, the studs of said individually-different, displayable, demonstration stud-mounted stones being dimensioned to project substantial distances inwardly of the inner surface of a selected, displayable, demonstration jewelry item of said plurality of individually-different, displayable, demonstration jewelry items, said studs thereby providing means by which they may be easily held for temporary displaying of one of more of said selected, stud-mounted, displayable, demonstration stone or stones immediately adjacent said selected, displayable, demonstration, jewelry item, whenever said one or more selected, stud-mounted, displayable, demonstration stone or stones is or are disposed in juxtaposition to said selected, displayable, demonstration jewelry item to enable a viewer to visualize the position or positions which the ultimate stone or stones, represented by said one or more selected, stud-mounted, displayable, demonstration stone or stones, would occupy when secured to the ultimate jewelry item corresponding to said selected, displayable, demonstration jewelry item.

14. A remount kit as claimed in claim 13 wherein the studs of said individually-different, stud-mounted, displayable, demonstration stones are eccentric of the geometric centers of said displayable, demonstration, stud-mounted stones, whereby rotation of one of said stud-mounted stones while the stud of said one stud-mounted stone is held adjacent said selected displayable, jewelry item will cause said one stud-mounted stone to move in two directions laterally of said selected, displayable, jewelry item.

15. A remount kit for stone-bearing rings which comprises a plurality of individually-different, displayable, demonstration rings, each of which is formed and dimensioned to represent an ultimate ring to which at least one ultimate stone can be secured, and a plurality of individually-different, stud-mounted, displayable, demonstration stones, each of which is formed and dimensioned to represent an ultimate stone which could be secured to at least one of the ultimate rings represented by said plurality of individually-different, displayable, demonstration rings, the studs of said individually-different, stud-mounted, displayable, demonstration stones being dimensioned to project substantial distances inwardly of the finger-engaging surface of a selected, displayable, demonstration ring of said plurality of individually-different, displayable demonstration rings, said studs thereby providing means by which they may be easily held for temporary displaying of one or more selected, stud-mounted, displayable, demonstration stone or stones immediately adjacent said selected, displayable, demonstration ring, whenever said one or more selected, stud-mounted, displayable, demonstration stone or stones is or are disposed in juxtaposition to said selected, displayable, demonstration ring to enable a viewer to visualize the position or positions which the ultimate stone or stones, represented by said one or more selected, stud-mounted, displayable, demonstration stone or stones, would occupy when secured to the ultimate ring corresponding to said selected, displayable, demonstration ring and also to enable the viewer to visualize the appearance of said ultimate ring and ultimate stone or stones in any desired attitude or position of said ultimate ring by enabling said selected, displayable, demonstration ring to be moved to any corresponding attitude or position while having said one or more selected, stud-mounted, displayable, demonstration stone or stones temporarily associated with it two-dimensional representations of selected rings of said plurality of individually-different, displayable, demonstration rings have a space therein which can have the locations and natures of stones recorded thereon to facilitate the subsequent proper positioning of one or more of said ultimate stones on said ultimate ring.

* * * * *